United States Patent [19]

Hurta et al.

[11] Patent Number: 4,596,375

[45] Date of Patent: Jun. 24, 1986

[54] HYDRAULIC CONTROL OF SUBSEA WELL EQUIPMENT

[75] Inventors: Gary L. Hurta, Houston; Lionel J. Milberger, Spring; Alford M. Williams, Houston, all of Tex.

[73] Assignee: Vetco Offshore, Inc., Ventura, Calif.

[21] Appl. No.: 625,341

[22] Filed: Jun. 27, 1984

Related U.S. Application Data

[62] Division of Ser. No. 319,179, Aug. 13, 1981, Pat. No. 4,497,369.

[51] Int. Cl.[4] ..... F16K 31/122; E21B 34/04

[52] U.S. Cl. ..... 251/24; 166/368; 251/63

[58] Field of Search ..... 251/63.4, 63, 62, 175, 251/176, 174, 24; 137/628; 166/316, 319, 332, 368, 362–364, 338, 366

[56] References Cited

U.S. PATENT DOCUMENTS

| | | | |
|---|---|---|---|
| 2,896,903 | 7/1959 | Canalizo | 251/63 |
| 3,776,276 | 12/1973 | Stiltner | 251/175 X |
| 3,993,100 | 11/1976 | Pollard et al. | 166/338 X |
| 4,185,652 | 1/1980 | Zintz et al. | 137/628 X |
| 4,304,253 | 12/1981 | Roger | 251/62 X |
| 4,336,826 | 6/1982 | Grawande | 251/63.40 X |

*Primary Examiner*—James A. Leppink
*Assistant Examiner*—Hoang C. Dang
*Attorney, Agent, or Firm*—Arthur E. Fournier, Jr.

[57] ABSTRACT

A control system (10) employable for purposes of effecting the operation of a plurality of actuable devices, which are located at a subsea site, from a position that is remote therefrom. More specifically, the subject control system (10) is particularly suited for employment for purposes of hydraulically effecting the operation of the valves of a subsea christmas tree (30). To this end, the subject control system (10), on the one hand, is connected in fluid flow relation with a surface control center (16) from which hydraulic fluid is supplied under pressure, and, on the other hand, is connected to a subsea sequence valving means (12) which receives the hydraulic fluid under pressure from the surface control center (16) and in turn transmits hydraulic power to the operators (46, 48, 50, 52, 54, 56) of the christmas tree valves to cause the latter to move in accordance with a predetermined operating program (32). The subject control system (10) is characterized by the flexibility that it possesses in terms of the diversity of operating programs (32) that can be employed therewith, by the fact that the sequence valving means (12) embodies constant force spring means (88) which enables the elimination of one hydraulic line between the surface control center (16) and the subsea site of the christmas tree (30), and by the embodiment in the subsea sequence valving means of new and improved duplex shear seal means (86) operative for preventing interflow.

5 Claims, 12 Drawing Figures

TREE SCHEMATIC

| | 32 SCSSV | AM | PML | PMU | XO | AW | PW |
|---|---|---|---|---|---|---|---|
| 62 SHUT-IN | C | C | C | C | C | C | C |
| 64 PIG FLOWLINES | O | O | O | O | O | O | O |
| 66 TEST SCSSV | C | C | O | O | C | O | O |
| 68 ANNULUS MONITOR | C | O | O | O | C | O | C |
| 70 PRODUCTION | O | O | O | O | C | O | O |
| 72 PROD. THRU ANNULUS | O | C | O | O | O | O | O |

INDEPENDENT

TREE VALVE
C = CLOSED
O = OPEN

HYDRAULIC CONTROL OF SUBSEA WELL EQUIPMENT

This is a Division of application Ser. No. 319,179 filed Aug. 13, 1981, now U.S. Pat. No. 4,497,369.

BACKGROUND OF THE INVENTION

This invention relates to control systems, and more particularly to a hydraulic control system for effecting the operation of the valves of a subsea christmas tree from a location that is remote therefrom.

It has long been commonplace to effect the production of oil and/or gas from subsea wells. However, for the most part the oil and/or gas producing subsea wells, which have existed heretofore, were drilled at relatively shallow depths. Now, though, in the continuing quest for additional supplies of oil and/or gas, such subsea wells are being drilled with ever increasing frequency at greater and greater depths.

In further reference to the above, once the drilling of such subsea wells at these relatively greater depths has been successfully accomplished, i.e., once the oil or the gas has been found, there still nonetheless remains the task of producing the oil or the gas therefrom. To this end, as is well-known to those who are skilled in this art, the normal practice is to emplace at the subsea well site, a piece of well equipment that most commonly is referred to as a christmas tree. The latter christmas tree is cooperatively associated with the subsea well such that control may be exercised therewith over the production of oil or gas from the well. For this purpose, the christmas tree is suitably provided with a plurality of valve means.

Accordingly, there, therefore, exists a need to establish operational control over this plurality of valve means. However, because of the fact that the christmas tree and thus the valve means thereof are positioned at the subsea well site, which is located at a considerable water depth, control is generally exercised over the valve means from a remote location. In turn, this necessitates the use of some form of control means that is operative notwithstanding the fact that it must be capable of operating over an extended distance, i.e., between the subsea well site whereat the christmas tree is located and the remote location from whence it is desired that control over the valve means of the christmas tree be effectuated.

Apart from simply being capable of accomplishing therewith the requisite operation of the valve means of the subsea christmas tree, any control system that may be selected for use in this regard should also be advantageously characterized in certain other respects. For instance, additionally such a control system should be characterized by the fact that it is capable of performing in a substantially trouble free manner even though operated under conditions which demand extensive usage therefrom. That such a characteristic is desirable will be readily apparent to all when one considers the location of the valve means over which the control system is intended to effect control, and when one envisages the difficulties of having to make repairs on the control system at the site of the valve means should a need therefor arise. Another characteristic, which it is desirable that such a control system possess, relates to the cost of providing the system. Namely, because of the fact that the control system is required to function over an extended distance as well as in a considerable depth of water, it is desirable that the means by which the control system accomplishes the control function over the valve means of the subsea christmas tree be advantageously characterized as regards both its relative simplicity as well as its relative low-cost.

Notwithstanding the fact that the control system, which is selected for use for the purpose found described above, may be advantageously characterized in that it is capable of providing relatively trouble free operation, there still exists a need for effecting normal maintenance thereon. Moreover, the ease with which such maintenance can be performed, both in terms of the time and effort that must be expended in the accomplishment thereof, is an important consideration for the user of such equipment. To this end, when wells were being drilled offshore at relatively shallow depths, it was found to be both feasible and desirable to utilize divers to accomplish the required maintenance and/or repairs on the equipment located at the subsea well site including such items of equipment as the christmas tree itself, the valve means associated therewith, etc., as well as the control system extending between the subsea christmas tree and the surface control center from whence control is exercised over the valve means of the christmas tree. However, as production wells are being drilled with increasing frequency in deeper and deeper depths of water, it is becoming no longer feasible to make use of divers for purposes of accomplishing the maintenance and/or repair functions that are referred to above. Rather, there is being generated a need for the utilization of control systems that possess ever increasing reliability, as well as control systems that are ever less costly to provide.

There have been attempts made with varying degrees of success by the prior art relative to addressing the need for new and improved forms of control over the production of oil or gas from subsea well sites. That is, in accordance with the teachings of the prior art, there are known to have been provided heretofore various forms of subsea production control systems operative for purposes of exercising from remote locations control over subsea christmas trees. The latter christmas tree, as has been previously mentioned herein, are designed to be emplaced on oil or gas wells in order to control with the trees the flow of product from the wells. Typically, the christmas trees include a series of valve means having hydraulic operators by means of which the opening and the closing of the valve means is accomplished. To this end, upon pressurization with a hydraulic fluid, the hydraulic operators of the valve means cause the latter to occupy either an open or closed position depending upon what the orientation of the valve means is at the time of the pressurization. Thereafter, upon depressurization of the hydraulic operators of the valve means, the latter are caused to occupy the other position thereof, i.e., are made to assume their original positions. Namely, if prior to pressurization the valve means occupied a closed position, upon pressurization of the hydraulic operators the valve means are caused to move from the closed position to an open position, and upon depressurization of the hydraulic operators the valve means are made to reassume their closed position, i.e., are caused to move from an open to a closed position. On the other hand, if the valve means are in an open position prior to the pressurization of the hydraulic operators thereof, the opposite will occur. Namely, upon pressurization the valve means will move to the closed position, and upon depressurization the valve means will reassume the open position.

By way of a generalization, it is possible to categorize prior art forms of subsea production control systems according to the manner in which the actuation of the hydraulic operators of the valve means of the subsea christmas tree is accomplished. Further to this point, it can be said that there exist subsea production control systems which are classifiable into the following categories: direct hydraulic systems, sequenced hydraulic systems, electro hydraulic systems and multiplexed electro hydraulic systems. For purposes of the discussion that follows hereinafter, though , attention is focused in particular upon that category of subsea production control system that has been referred to above as a sequenced hydraulic system.

Basically, a sequenced hydraulic system is a system wherein there are provided by means of a pilot line specified hydraulic pressure levels corresponding to certain operation modes for a christmas tree, and these specified pressure levels are employed for purposes of effecting control over the operation of the valve means that are cooperatively associated with the christmas tree. As regards prior art forms of sequenced hydraulic systems, they have all suffered in one respect or another from some type of readily identifiable shortcoming or deficiency. In particular, prior art forms of sequenced hydraulic systems suffer insofar as concerns the capability thereof to maintain reliability through simplicity, and concomitantly, therefore, enable economies to be realized in terms of the cost of providing the system as well as the cost to the user of employing the system.

Essentially, it can be said that all prior art types of sequenced hydraulic systems embody some form of valving means that is designed to be connected in operative relation to the valve means of the subsea christmas tree. More specifically, all such prior art types of sequenced hydraulic systems embody a form of construction which is dependent for its operation upon the fact that a pressure bias is applied to the aforesaid valving means which the subject sequenced hydraulic system embodies. Unfortunately, however, in order to utilize a mode of operation which makes use of a pressure bias it necessitates the running of an additional hydraulic line between the subsea christmas tree and the surface control center from whence control is exercised over the valve means of the subsea christmas tree. The requirement of providing such an additional hydraulic line serves to disadvantageously characterize from a cost standpoint those prior art sequenced hydraulic systems that make use of a pressure bias mode of operation. For an example of such a prior art type of sequenced hydraulic system that utilizes a pressure bias mode of operation, reference may be had to the product literature of the Hydril Company.

Another prior art type of sequenced hydraulic system comprises the subject matter of U.S. Pat. No. 3,993,100. In accordance with the teachings of this patent, a sequenced hydraulic system is provided that does not require a separate hydraulic line to effect the biasing of the valving means which the system embodies. Rather, the sequenced hydraulic system as taught in U.S. Pat. No. 3,993,100 utilizes a subsea mounted regulator means for purposes of effecting the pressure bias that is applied to the valving means of the system. Although such a system avoids the costs associated with providing an hydraulic line between the subsea christmas tree and the surface control center, this system likewise is disadvantageously characterized. More specifically, the shortcoming of the sequenced hydraulic system that forms the subject matter of U.S. Pat. No. 3,993,100 resides in the use of the subsea mounted regulator means. Such regulator means have proven in the past to be unreliable. Moreover, they have exhibited a tendency to be subject to drift and pressure variations. Accordingly, because of the uncertainty shown by such subsea mounted regulator means, the pressure biasing forces to which the valving means of the system is subjected can change thereby resulting in the establishment of erroneous biasing forces which concomitantly can lead to the incorrect exercise by the system of control over the operation of the subsea christmas trees, i.e., can result in faulty control being exercised over the flow of product from the subsea well with which the christmas tree being controlled by the system of U.S. Pat. No. 3,993,100 is cooperatively associated.

Yet another illustration of a prior art type of sequenced hydraulic system can be found described in the product literature of Cameron Iron Works. In this system, reliance is had solely on the use of the supply pressure of the hydraulic fluid to effect the biasing of the valving means of the system. Although this method of accomplishing the pressure biasing of the valving means of the system eliminates the need both of running an additional hydraulic line from the surface control center to the subsea christmas tree and of making use of a subsea mounted regulator means, the system is highly dependent upon the existence of a very stable supply pressure. This dependency serves to disadvantageously characterize such a system inasmuch as a flow demand at the subsea location in combination with the presence of normal restrictions in the hydraulic supply line can cause pressure drops to occur in the latter supply line, which as noted establishes the biasing pressure to which the valving means of the system is subjected. In turn these pressure drops can cause the establishment of uncontrollable bias force variations on the valving means of the system and thus produce erratic performance, i.e., faulty control over the flow of product from the subsea well.

Yet still another example of a prior art type of hydraulically actuated subsea production control system is the indexing type of system provided by the FMC Corporation. Although this latter type of system is characterized by the fact that it overcomes some of the shortcomings from which prior art forms of sequenced hydraulic systems suffer, it does not itself make use of valving means that functions in a sequential fashion and which is responsive to predetermined pressure levels that are established in a pilot line. Thus, this indexing type of system fails to address the need which has been shown to exist for a sequenced hydraulic system that possesses the capability of being able to maintain therewith reliability through simplicity and thus further of being able to reduce therewith the cost of providing the system as well as the operating costs to the users of employing the system.

It is therefore, an object of the present invention to provide a new and improved form of a subsea production control system, which is operative for purposes of effecting control over the operation of a subsea christmas tree from a surface location remote therefrom.

It is another object of the present invention to provide such a subsea production control system which is operative in the manner of a sequenced hydraulic system; namely, the system includes valving means that is operative in a sequential fashion in response to the existence of certain predetermined pressure levels in a pilot line.

It is still another object of the present invention to provide such a subsea production control system which is advantageously characterized in that it minimizes both the number of control lines that are required to be run between the subsea christmas tree and the surface control center from whence control over the subsea christmas tree is effected, and the number of subsea control valves required for operation of the system.

Another object of the present invention is to provide such a subsea production control system that possesses the flexibility of enabling a variety of different operating programs for subsea christmas trees to be executed therewith.

A further object of the present invention is to provide such a subsea production control system that utilizes a new and improved form of sequence valving means, the latter being characterized both in that it has a small dead band and in that it permits the elimination of the use of shuttle valves interposed between the sequence valving means and the valve means of the subsea christmas tree.

A still further object of the present invention is to provide such a subsea production control system embodying such a new and improved sequence valving means wherein the latter sequence valving means is designed to be located in or on the tree cap of the subsea christmas tree.

Yet another object of the present invention is to provide such a subsea production control system embodying such a new and improved sequence valving means wherein the latter in turn embodies a new and improved constant force spring means which is operative for purposes of effecting a biasing of the gate means of the sequence valving means such that the latter possesses a mode of operation wherein the biasing thereof is accomplished by both constant force mechanical spring means and hydraulic pressure, and wherein assistance is provided in the form of hydraulic pressure in the shifting of the internal components of the sequence valving means to cause the latter to occupy either an open or closed operating position.

Yet still another object of the present invention is to provide such a subsea production control system embodying such a new and improved sequence valving means wherein the latter in turn embodies a new and improved low friction duplex shear seal means that is operative to prevent interflow within the sequence valving means.

Yet a further object of the present invention is to provide such a subsea production control system which allows for the use of a multi-piston control valve means located in the fluid lines that function to fluidically interconnect the sequence valving means with the valve means of the subsea christmas tree.

SUMMARY OF THE INVENTION

In accordance with one aspect of the present invention, there is provided a new and improved subsea production control system that is operative in the manner of a sequenced hydraulic system for purposes of effecting control from a remote surface location over the flow of product from a subsea oil or gas well. The subject subsea production control system includes sequence valving means mounted on a christmas tree which is located at the subsea well site. This sequence valving means is connected in fluid flow relation to a surface control center that typically is located on a fixed offshore platform and from whence the control over the flow of product from the subsea well is effected. To this end, the subject subsea production control system further includes a plurality of hydraulic control lines that extend between the subsea well site and the surface control center. One line of this plurality of hydraulic control lines is intended to function as a supply line. That is, hydraulic fluid is pumped from the site of the surface control center through this line to the sequence valving means located at the subsea well site to furnish the hydraulic power required to move the operators of the valve means of the subsea christmas tree. Another line of this plurality of hydraulic control lines functions as a pilot line wherein in response to the establishment of certain predetermined pressure levels therewithin the sequence valving means operatively connected thereto is made to port fluid to or to vent fluid from the operators of the valve means of the subsea christmas tree.

In accord with another aspect of the present invention, there is provided a new and improved form of sequence valving means that is particularly suited for employment in a subsea production control system constructed in accordance with the present invention. The subject sequence valving means includes a body having a generally cylindrical bore formed therein so as to extend along an axis thereof. Gate means including a multiplicity of shear seal elements is mounted for movement within this bore. A constant force spring means suitably retained in a conventional type of spring retention housing applies a biasing force to the aforesaid gate means causing the latter to be biased in a first direction. Additional biasing is applied to the gate means by the pressure of the hydraulic fluid that is supplied to the sequence valving means. In response to the establishment of a certain predetermined level of pressure in the pilot line that is operatively connected to the sequence valving means, a force is generated causing the gate means to move in a direction opposite to that to which the gate means is biased by the constant force spring means. Thereafter, through the suitable application of pressure to the sequence valving means the gate means thereof can be made to return to its other position, i.e., to the position to which it is being biased by the constant force spring means.

In accord with a further aspect of the present invention, there is provided a new and improved form of constant force spring means that is particularly suited for embodiment in a sequence valving means constructed in accordance with the present invention. Such a constant force spring means is advantageously characterized in comparison to a conventional spring in that wherein the latter has a given spring rate, i.e., the further the spring is compressed the higher is the resulting force, a constant force spring has a zero spring rate over a sufficiently large displacement range. The advantage of the latter characteristic as applied to a sequence valving means is that no dead band occurs due to spring rate. A further requirement of sequence valving means is that a spring employed therein must be capable of providing a force of approximately 1800 pounds over a deflection range of 0.3 inches. This is occasioned by the fact that the spring bias force must be sufficiently large as compared to the frictional forces present in the sequence valving means in order to maintain a small dead band.

In accord with yet another aspect of the present invention, there is provided a new and improved form of shear seal that is particularly suited for employment in a sequence valving means constructed in accordance with the present invention. The subject shear seal comprises a duplex shear seal that is operative both to prevent interflow and to reduce the sliding friction of the gate means with which the duplex shear seal is operatively associated. Further, the subject duplex shear seal is advantageously characterized in that it effects the establishment of three balanced forces on the gate means thereby preventing lockup thereof.

DESCRIPTION OF THE PREFERRED EMBODIMENT

Figure 1:
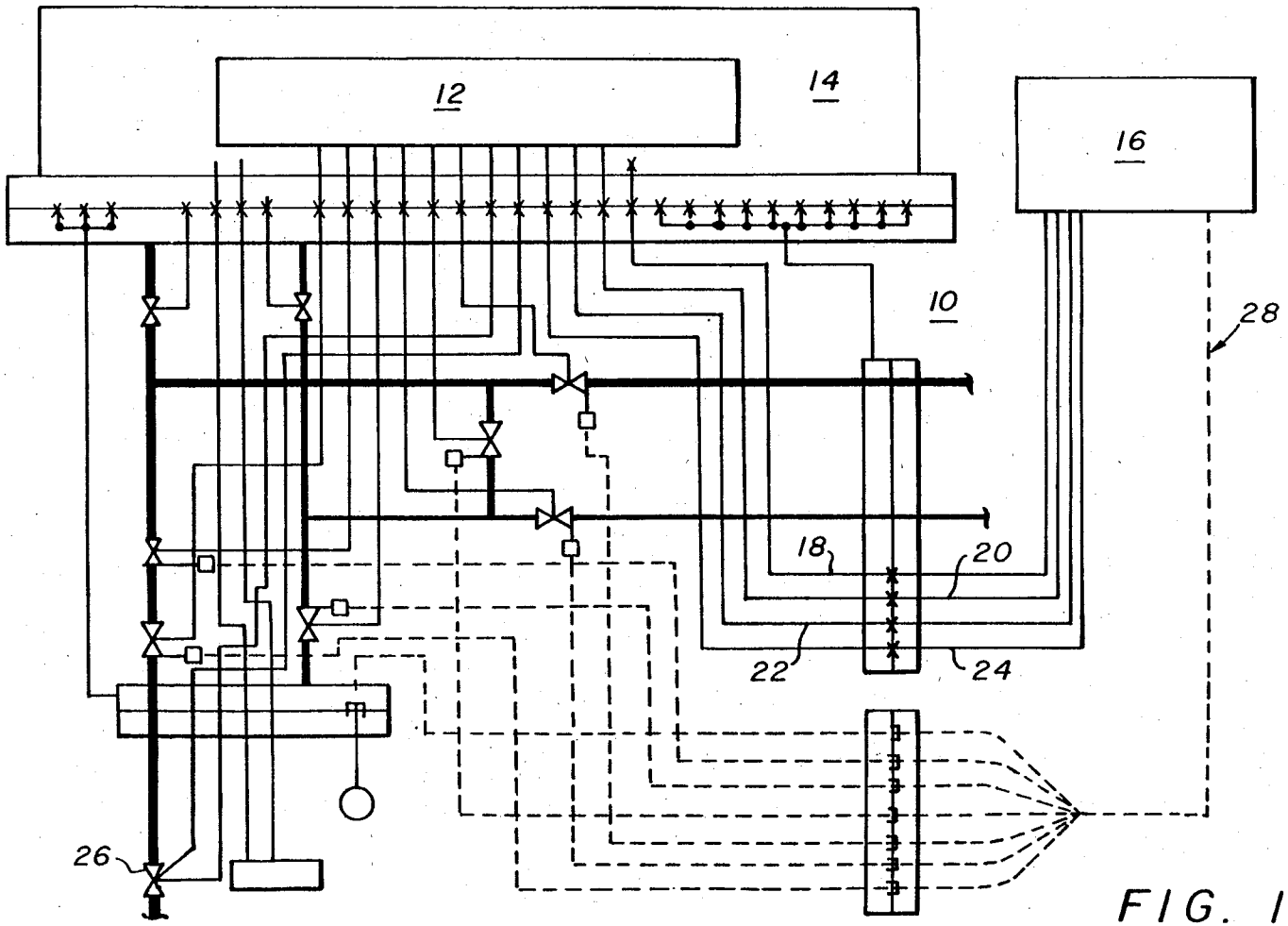
FIG. 1 is a schematic diagram of a subsea production control system constructed in accordance with the present invention.

Referring now to the drawing, and more particularly to FIG. 1 thereof, there is depicted therein a schematic diagram of a subsea production control system, which is constructed in accordance with the present invention, and which in FIG. 1 is designated generally by the reference numeral 10. For purposes of acquiring an understanding of the subject matter of the present invention, it is not deemed necessary to provide herein a detailed description of the schematic diagram of FIG. 1. Rather, a brief general description of the major structural operating components of the subsea production control system 10, as shown in FIG. 1, is believed to be sufficient for purposes of understanding the present invention. To this end, the subsea production control system 10 is intended to be operative for purposes of exercising control from a remote surface location over the flow of product from a subsea oil or gas well. Thus, as best understood with reference to FIG. 1, the subsea production control system 10 includes a sequence valving means, generally designated by the reference numeral 12, which is shown mounted on a tree cap, generally designated by the reference numeral 14, of a subsea christmas tree. In addition, the subsea production control system 10, as depicted in FIG. 1, is connected to a surface control center, generally designated by the reference numeral 16, which typically is located on a fixed offshore platform, by means of a plurality of hydraulic control lines. The number of hydraulic control lines employed for this purpose in accordance with the illustrated embodiment of the invention is preferably four, i.e., lines 18, 20, 22 and 24. Three of these lines, i.e., those denoted by the numerals 20, 22 and 24, are intended to be utilized, whereas line 18 is principally intended to be in the nature of a spare hydraulic line extending between the surface control center 16 and the sequence valving means 12.

With further regard to the three hydraulic control lines 20, 22 and 24, one of these lines, i.e., that designated in FIG. 1 by the reference numeral 24, functions as a supply line. As such, hydraulic fluid under pressure is pumped from the surface control center 16 through line 24 to the subsea sequence valving means 12. The hydraulic fluid flowing through line 24 is provided to the sequence valving means 12 so as to furnish the hydraulic power through which, as will be more fully described hereinafter, the actuation of the operators of the valve means of the subsea christmas tree is effected by the sequence valving means 12. Namely, the subsea sequence valving means 12 causes the individual valves thereof to open or close, and thus to port fluid to or to vent fluid from the operators of the valve means of the subsea christmas tree. A second of the aforesaid three lines, i.e., the line denoted by the reference numeral 20, is a pilot line which opens and closes the individual valves of the sequence valving means 12 when predetermined pressure settings exist in the pilot line 20. To this end, the pressure of the hydraulic fluid flowing in the pilot line 20 is raised or lowered therein to effect the functioning of the individual valves of the sequence valving means 12. The last of the three lines, i.e., the line designated by the reference numeral 22, is used to provide hydraulic fluid for and to control the surface controlled subsurface safety valve (SCSSV). The latter which is commonly placed in subsea oil or gas wells is denoted by reference numeral 26 in FIG. 1. In the configuration of the subsea production control system 10 as illustrated in FIG. 1 of the drawing, the SCSSV 26 is controlled independently of the sequence valving means 12. However, it is to be understood that the SCSSV 26 could be controlled through the sequence valving means 12 without departing from the essence of the present invention. A final note with regard to the schematic diagram of the subsea production control system 10 as it appears in FIG. 1 is that the dotted lines, generally designated therein by the reference numeral 28, are intended to depict electrical connections that extend between the surface control center 16 and other operating components of the subsea production control system 10.

Figure 2:
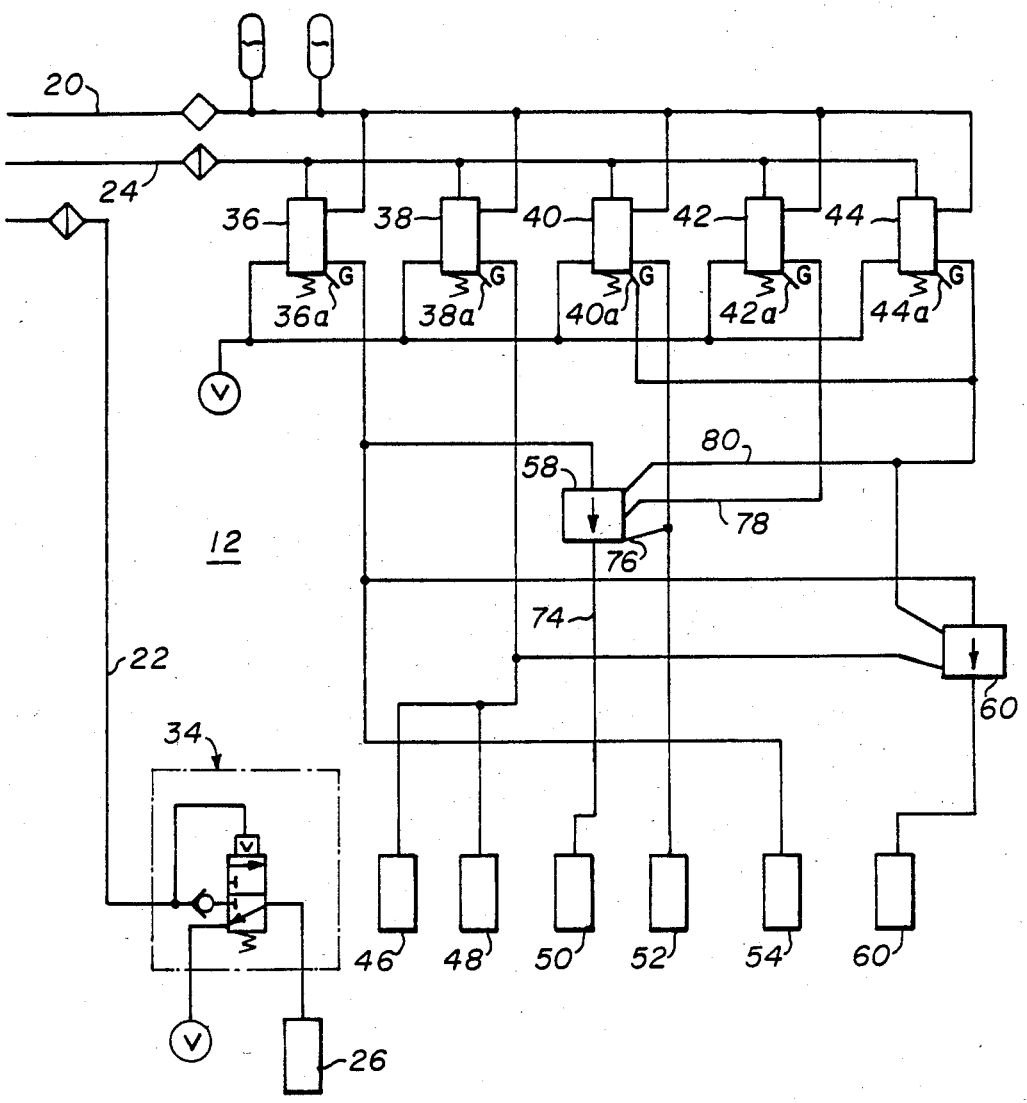
FIG. 2 is a flow diagram of the sequence valving means portion of a subsea production control system constructed in accordance with the present invention.

Turning now to FIG. 2 of the drawing, there is illustrated therein a flow diagram of the sequence valving means 12. In addition, in FIG. 2A there is depicted a schematic diagram of a subsea christmas tree, generally designated therein by the reference numeral 30, of the type with which the subsea production control system 10 of FIG. 1 is designed to be cooperatively associated. While in FIG. 2B there is illustrated in table form a preferred operating program, generally designated therein by the reference numeral 32, for the subsea christmas tree 30 of FIG. 2A.

Continuing with a description of the flow diagram of the sequence valving means 12 that is illustrated in FIG. 2, it is not deemed necessary for purposes of understanding the subject matter of the present invention to provide herein a detailed description of the flow diagram of FIG. 2. Rather, a general description of the major structural operating components that are depicted in FIG. 2 is deemed to be sufficient for purposes of acquiring an understanding of the present invention. To this end, there appears in the flow diagram of FIG. 2 the hydraulic fluid supply line, designated by the reference numeral 22 in FIG. 1, which functions to supply hydraulic fluid to the SCSSV 26. As depicted in FIG. 2, a quickdump valve, generally designated by the reference numeral 34, embodying any suitable form of conventional construction is interposed in the fluid supply line 22 such as to be connected in fluid flow relation with the SCSSV 26. In addition, there appears in the flow diagram of FIG. 2 the pilot line 20 and the hydraulic fluid supply line 24, both of which have previously been referred to herein in connection with the description of the schematic diagram illustration of FIG. 1 of the subsea production control system 10.

As best understood with reference to FIG. 2, the pilot line 20 and the supply line 24 are each connected in fluid flow relation to each of a series of five sequence or mode valves 36, 38, 40, 42 and 44. In accord with the preferred operating program 32 of the subsea christmas tree 30, each of the sequence valves 36, 38, 40, 42 and 44 embodies the construction of a normally closed, three way, two position valve. Although for purposes of the embodiment of the sequence valving means 12 shown in FIG. 2 five sequence valves 36, 38, 40, 42 and 44 are employed, it is to be understood that a greater or a less number thereof could equally well be employed without departing from the essence of the present invention. Further to this point, the number of sequence valves 36, 38, 40, 42 and 44 which is selected for employment in the sequence valving means 12 is a function of the number of valve means of the subsea christmas tree 30 that it is desired to have actuated by the sequence valves 36, 38, 40, 42 and 44. In this regard, for purposes of the illustration of FIG. 2 the operators of six such valve means, i.e., the operators 46, 48, 50, 52, 54 and 56, that are associated with the subsea christmas tree 30 have been depicted. Moreover, for purposes of the description that follows hereinafter of the mode of operation of the sequence valving means 12, these six christmas tree valve operators are further characterized as follows: the operators 46 and 48 are each associated with a PM valve, the operator 50 is associated with a PW valve, the operator 52 is associated with an AM valve, the operator 54 is associated with an AW valve and the operator 56 is associated with an XO valve. Finally, in accord with the preferred operating program 32 of the subsea christmas tree 30, the sequence valving means 12 further includes a pair of intermediate valves 58 and 60 for a purpose yet to be described. Each of the intermediate valves 58 and 60, for purposes of accomplishing the preferred operating program 32 embodies the construction of a normally open, three way, two position valve. In conclusion, note is simply made here of the fact that the intermediate valve 58 is interposed in fluid flow relation with the operator 50 of the PW valve of the subsea christmas tree 30, whereas the intermediate valve 60 is connected in fluid flow relation to the operator 56 of the XO valve of the subsea christmas tree 30.

Referring further to the sequence valving means 12 as depicted in the flow diagram of FIG. 2, and more particularly to the operating program 32 which the former is intended to carry out, it is to be understood that although the program 32 represents the program which applicants' assignee prefers to employ, it has been found from experience that wide variations exist in such operating programs due principally to the presence of differences in the configurations of individual christmas trees as well as due to the presence of differences in the operating preferences of the individual users thereof. Obviously, therefore, it is desirable that any subsea production control system, e.g., the system 10 of FIG. 1, which is selected for use possesses the capability of enabling such variations in operating programs to be accommodated therewith without requiring that the system undergo any significant major design change in order to enable the system to accommodate such variations in operating programs.

Figures 2A, 2B:
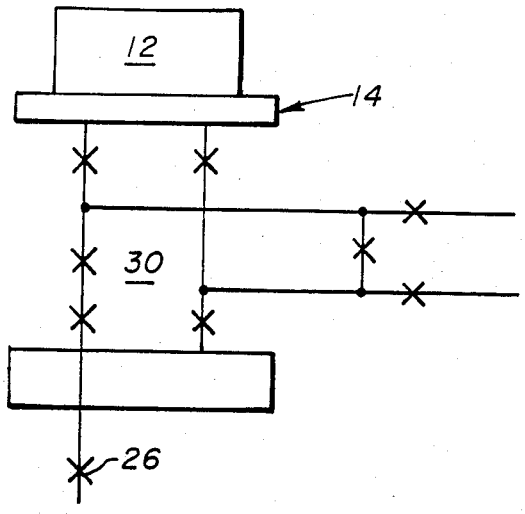
FIG. 2A is a schematic diagram of a subsea christmas tree of the type that is particularly suited to having its operation controlled by means of the sequence valving means shown in the flow diagram of FIG. 2.
FIG. 2B is a preferred operating program, presented in a table format, for a subsea christmas tree of the type that is particularly suited to having its operation controlled by means of the sequence valving means shown in the flow diagram of FIG. 2.

With particular reference in this regard to the subsea production control system of FIG. 1 in general, and the sequence valving means 12 thereof in particular, as illustrated in FIG. 2, flexibility in terms of the system's capability to execute therewith a variety of different operating programs for subsea christmas trees is maintained in the system 10 mainly by virtue of the fact that the sequence or mode valves, e.g., valves 36, 38, 40, 42 and 44, that are employed therein are used to define the modes of the preferred operating program 32, which appears in FIG. 2B. For purposes of this discussion, the operating program 32 depicted in FIG. 2B is deemed to contain six operating modes identified therein through the use of the reference numerals 62, 64, 66, 68, 70 and 72. Namely, each of the six legends which appear along the left side of the table of FIG. 2B corresponds to a specific operating mode of the subsea christmas tree 30 of FIG. 2A, e.g., mode 1 identified by the numeral 62 is associated with the operating mode of the subsea christmas tree 30 denoted by the legend "SHUT-IN", etc. More specifically, the sequence or modes valves, e.g., the valves 36, 38, 40, 42 and 44 define the modes 62, 64, 66, 68, 70 and 72 of the preferred operating program 32 in response to the pressurization of the respective mode valve's output port when a predetermined pilot pressure is reached in the pilot line 20. As will be best understood with reference to FIG. 2, in those instances wherein the operator of the christmas tree valve is connected directly to the mode, i.e., sequence, valve output, i.e., in the manner of the operator 54 which is connected directly to the output of the mode valve 36 that particular operator will open and remain open throughout the operation of the entire program.

System flexibility is further enhanced in the case of the subsea production control system 10 of FIG. 1 in general and the sequence valving means 12 of FIG. 2 in particular, through the use of the reset piston, i.e., G port, with which each of the sequence or mode valves 36, 38, 40, 42 and 44 is provided. For purposes of identification, these reset pistons, i.e., G ports, are denoted in FIG. 2 by means of the reference numerals 36*a*, 38*a*, 40*a*, 42*a*, 44*a*, respectively. When pressurized, each of the reset pistons 36*a*, 38*a*, 40*a*, 42*a* and 44*a* effects the resetting of its respective mode valve 36, 38, 40, 42 or 44 to the closed position thereof after the latter has first been moved to its open position by its respective pilot piston in response to the existence of certain specified levels of pressure in the pilot line 20. Mainly, the reset piston 36*a*, 38*a*, 40*a*, 42*a* or 44*a* utilized when one of the valves of the subsea christmas tree 30 is required, in accordance with the operating program 32, to be opened and then reclosed only once during the program. For example, the operator 52 of the annular master (AM) valve that appears in the flow diagram of FIG. 2, in accordance with the operating program 32 of FIG. 2B, is designed to be opened in mode 4, i.e., the mode identified by numeral 68 in FIG. 2B, and then reclosed in mode 6, i.e., the mode identified in FIG. 2B by numeral 72. To accomplish this part of the program 32, the AM christmas tree valve operator 52 is connected to the output of the mode valve 40 and the latter's reset piston, i.e., G port, 40*a* is connected to the output of the mode valve 44.

For those applications wherein more transitions from closed to open position occur in the operating program, the flexibility of the system 10 is maintained by employing in the sequence valving means 12 intermediate valves, e.g., the valves 58 and 60 of FIG. 2. More specifically, such intermediate valves 58 and 60 are interposed in the fluid lines that extend between the output of a corresponding one of the mode valves 36, 38, 40, 42 and 44, and the respective christmas tree valve operator 46, 48, 50, 52, 54 or 56 that is cooperatively associated therewith. In the case of the preferred operating program 32 appearing in FIG. 2B, there exists such an occurrence. Namely, in the case of the operator 50 which is operatively associated with the production wiring (PW) valve of the subsea christmas tree 30, there is a requirement that the PW valve be first opened in mode 2, i.e., the mode denoted by numeral 64 in FIG. 2B, then closed in mode 4, i.e., the mode denoted by numeral 68, then reopened in mode 5, i.e., the mode denoted by numeral 70, and then finally reclosed in mode 6, i.e., the mode denoted by numeral 72. The reset piston embodied by the appropriate mode valve cannot alone accomplish this many transitions. Accordingly, what is needed is an intermediate valve, e.g., the valve 58 of FIG. 2, which can be opened and closed by different pilot pistons connected to the appropriate output of a mode valve. To this end, with further reference to FIG. 2, the intermediate valve 58 is connected through output line 74 to the operator 50 associated with the PW valve of the christmas tree 30, and is connected by means of line 76 to the output of mode valve 40, by the line 78 to the output of mode valve 42, and by line 80 to the output of mode valve 44. It is to be understood here that the fluid flowing through the lines 76, 78 and 80 from the output of the mode valves 40, 42, and 44, respectively, is at different pressure levels such as to effect the requisite movement of different pilot pistons which the intermediate valve 58 embodies such as to accomplish the desired openings and closings of the operator 50. Thus, it can be seen from the above that through the use of only two types of operating components, i.e., the mode or sequence valves 36, 38, 40, 42 and 44, and the intermediate valves 58 and 60, it is possible to accomplish any combination of closings, i.e., C's, and openings, i.e., O's, that are to be found in an operating program, e.g., the program 32 of FIG. 2B, which is designed to be employed for purposes of exercising control over christmas tree valves. As shown from the above, all that is necessary is that the number of transitions which each of the christmas tree valve operators is required to perform be determined, and a decision then reached as to whether a reset piston along will suffice to meet the demand for this number of transitions, or whether an intermediate valve might be required. The final step then is to effect the requisite connections of the reset piston, i.e., the G port of the modes valves, and the pilot pistons of the intermediate valves to the outputs of the appropriate mode valves.

Figure 3A:
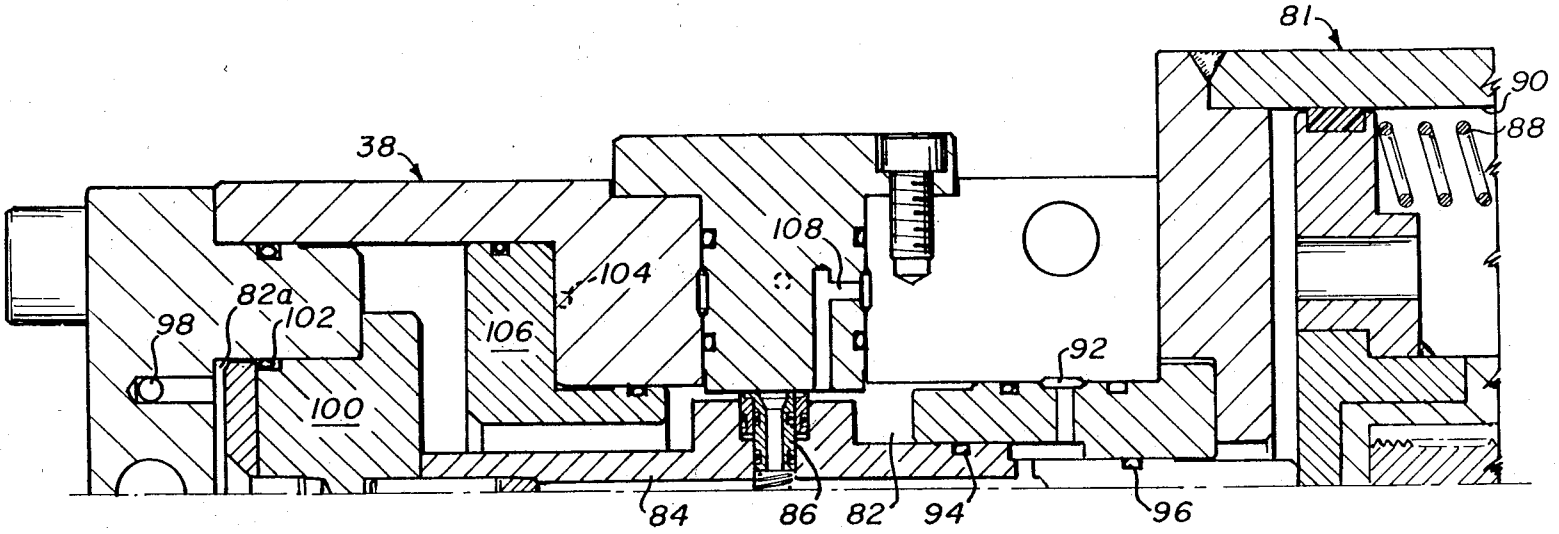
FIGS. 3A and 3B, when taken together, comprise a quarter sectional view with some parts broken away of a new and improved form of a sequence or mode valve which is particularly suited for employment in the sequence valving means portion of a subsea production control system constructed in accordance with the present invention.
Figure 3B:
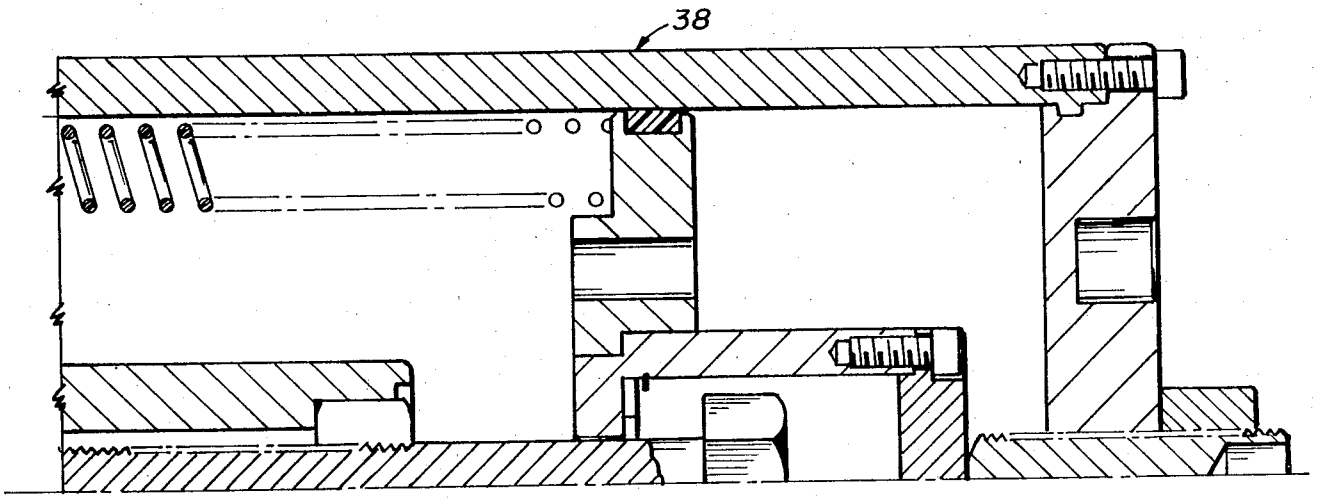
Figure 6:
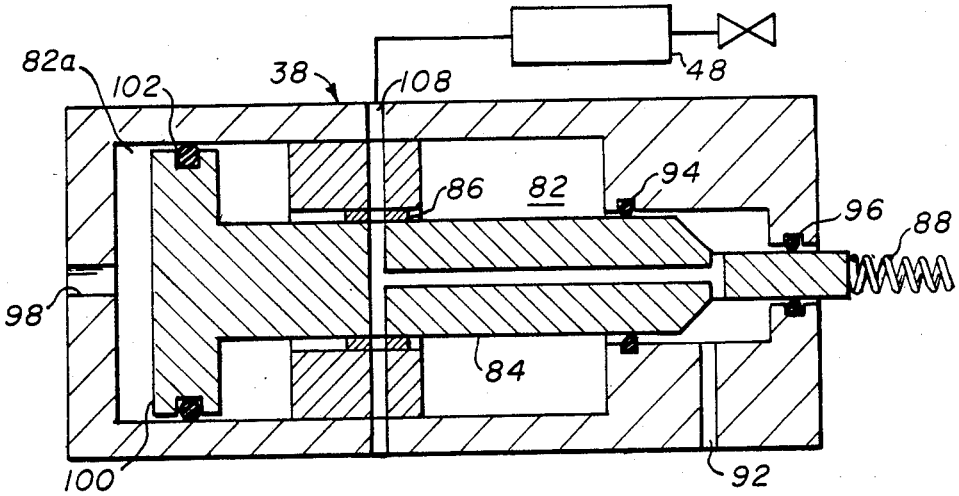
FIG. 6 is a diagrammatic representation in section of a sequence valve constructed as shown in FIGS. 3A and 3B.

For a description of the method of operation and the nature of the construction of the sequence or mode valves 36, 38, 40, 42 and 44 which the sequence valving means 12 of FIG. 2 embodies, reference will be had in particular to FIGS. 3A, 3B and 6 of the drawing. It is noted here that FIGS. 3A and 3B when taken together comprise a quarter sectional view of one of the sequence or mode valves 36, 38, 40, 42 and 44 of FIG. 2, whereas FIG. 6 is a diagrammatical representation in section of such a sequence or mode valve. With particular reference to FIGS. 3A and 3B, the sequence or mode valve, which for purposes of the following description will be considered to be the mode valve 38 of FIG. 2, includes a body member, generally designated by the reference number 81, that has formed therewith a bore 82. The latter bore 82, which is generally cylindrical in configuration is formed along the longitudinal axis of the body member 81. A gate 84 which includes a multiplicity, e.g., four in accord with the illustrated embodiment of the sequence valve 38, of shear seal elements 86 is suitably supported within the bore 82 for movement along the axis thereof. A constant force spring, identified by the reference numeral 88 in FIG. 3A and to which further reference will be had hereinafter, is suitably retained in a spring retainer housing, the latter being denoted by reference numeral 90, which is suitably provided for this purpose in the body member 81, such as to cause the gate 84 to be biased to the left as viewed with reference to FIG. 3A. Additional bias is applied to the gate 84 by means of the fluid which is supplied to the sequence valve 38 through the input port 92. That is, this additional bias is occasioned by the action of the pressure of the hydraulic supply fluid acting on the annular are defined by the seals 94 and 96. The significance of this additional bias, which the gate 84 has applied thereto, will be further discussed herein subsequently in connection with a description of the quick shift feature which the sequence valve 38 possesses.

Insofar as concerns the method of operation of the sequence valve 38, when pilot pressure fluid enters the body member 81 through the pilot pressure inlet port 98 and acts on the pilot piston 100, which is sealed by the seal 102 in the bore portion, identified as 82*a*, a force acting to the right as viewed with reference to FIG. 3A is created. Moreover, as the level of this pilot pressure is raised, a force greater than the force of the spring 88 plus the friction forces of seals 94, 96 and 102 as well as the friction forces of the shear seal elements 86 is developed thereby causing the gate 84 to move to the right as viewed with reference to FIG. 3A. Then, when fluid under pressure enters the body member 81 through the reset piston inlet port shown in phantom at 104 in FIG. 3A and is applied across the annular reset piston 106, a fluid force is developed that is greater than the fluid force developed by the pilot piston 100. Consequently, the gate 84 of the sequence valve 38 is caused to again shift to the left as viewed with reference to FIG. 3A. The outlet port through which fluid leaves the sequence valve 38 is identified at 108 in FIG. 3A. It is important to note here that insofar as the method of operation of the sequence valving means 12 of FIG. 2 is concerned, the various mode valves, i.e., the valves 36, 38, 40, 42 and 44 thereof shift in response to the existence in pilot line 20 of different levels of pilot pressure. Further, insofar as each individual one of the mode valves 36, 38, 40, 42 and 44 is concerned, this is accomplished by utilizing in each of these valves pilot pistons which are of differing diameters. That is, the diameter of the respective pilot piston of each of the mode valves 36, 38, 40, 42 and 44 is suitably selected so as to be responsive to the force applied thereto when the level of the pilot pressure in pilot line 20 reaches a specified value.

A characteristic of an advantageous nature that the mode valves 36, 38, 40, 42 and 44 each possess is that each have a small dead band. For purposes of this discussion, dead band is defined as being the difference in the pilot pressure which causes the valve to shift from the open to the closed position when the pilot pressure is increasing as compared to when the pilot pressure is decreasing. In this regard, it can be shown that the dead band is a function of both the frictional forces in the valve and the spring constant of the bias spring. The mode valves 36, 38, 40, 42 and 44 employed in the subsea production control system 10 of the present invention represent a significant improvement over prior art forms of sequence valves insofar as dead band is concerned. Much of the reason for the existence of this small dead band in the case of the sequence or mode valves 36, 38, 40, 42 and 44 is attributable to the use therein of low friction duplex shear seal elements of the type shown at 86 in FIG. 3A and of the use also therein of a constant force compression spring of the type shown at 88 in FIG. 3A.

A second manner in which the mode valves 36, 38, 40, 42 and 44 are advantageously characterized is with respect to their quick shift feature. This quick shift feature functions to assist the gate of the mode valve in shifting in either of its directions of movement. The benefit realized therefrom is that this quick shift action helps to ensure positive shifting of the mode valve, and prevents both sluggish action and sticking of the valve gate during shifting. For purposes of understanding the manner in which this quick shift action is accomplished reference will be had to FIG. 6 of the drawing. The latter Figure is intended to be a diagrammatic representation in section of the sequence valve 38, which is employed in the sequence valving means 12 of FIG. 2. As such, those elements of the sequence valve 38 that are common to both the FIGS. 3A and 3B, and the FIG. 6 are designated therein by the same reference numerals. Thus, with reference to FIG. 6, note is made of the existence therein of the following dimensional relationships. Namely, seal 102 is always larger in diameter than seal 94, and seal 94 is always larger in diameter than seal 96. Bearing the above relationships in mind, when the gate 84 moves to the right as viewed with reference to FIG. 6, the mode valve 38 is opening in order to port fluid through the output port 108 from the supply 92 to the christmas tree valve generator 48 with which the mode valve 38 is operatively connected in accordance with the flow diagram of FIG. 2. When this occurs, i.e., when fluid rushes to the christmas tree valve operator 48, a momentary pressure drop occurs in the supply line 92. This reduces the biasing force that is applied to the annular area defined by the seals 94 and 96, i.e., the pressure bias force developed across seals 94 and 96. This reduction in biasing force has the effect of assisting the gate 84 in moving to the right as viewed with reference to FIG. 6 of the drawing.

Now, when the gate 84 moves to the left as viewed with reference to FIG. 6, fluid from the christmas tree valve operator 48 flows into the vent cavity denoted at 82 in FIG. 6 and then out of the mode valve 38 to the system vent. This produces a pressure build up in the vent cavity 82 and which in turn causes this pressure to act on the rear surface of the pilot piston 100. Consequently, a force is thus developed which assists the gate 84 in moving to the left as viewed with reference to FIG. 6.

A third advantageous characteristic possessed by the mode valves 36, 38, 40, 42 and 44 resides in the fact that by virtue of the manner in which these valves are constructed twice the flow capacity is achieved with a given port size. The significance of this is that the distance which the gate of the valve must move, i.e., shift, to go from full open to full close is a major consideration in the design of a sequence or mode valve. In this regard, it is desirable to keep this travel as small as possible. As a general rule of design, the distance which the gate travels in shifting is twice the port size plus an additional amount for tolerances. In accord with the nature of the construction of the mode valves 36, 38, 40, 42 and 44, the port size employed is $\frac{1}{8}$ inch, and the gate travel is slightly greater than $\frac{1}{4}$ inch. Further, the hydraulic fluid supply, as best understood with reference to FIGS. 3A and 3B enters between the seals 94 and 96 and then flows along a 3/16 inch diameter hole inside the gate 84. Then the hydraulic fluid supply divides and exits the gate 84 through a pair of duplex shear seal element assemblies 86 and enters a $\frac{1}{8}$ inch diameter hole. Accordingly, the pressure drop in the sequence or mode valve 38, which is representative of all of the mode valves 36, 38, 40, 42 and 44 that are employed in the sequence valving means 12, is one-half that of prior art forms of valves embodying conventionally configured $\frac{1}{8}$ inch ports.

Figure 4:
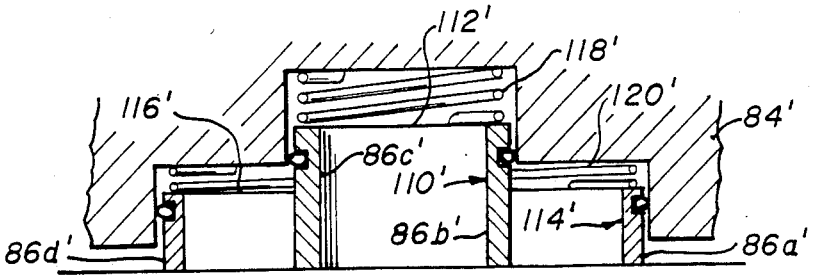
FIG. 4 is a diagrammatic representation in section of a first illustration of a new and improved form of a low friction duplex shear seal element which is particularly suited for employment in a sequence valve constructed as shown in FIGS. 3A and 3B.
Figure 5:
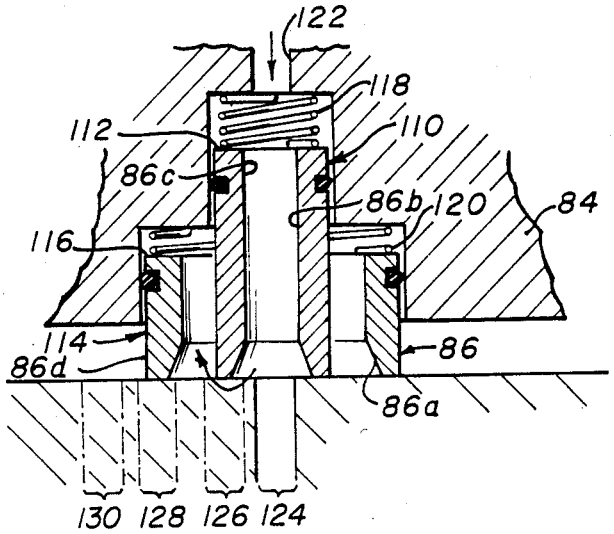
FIG. 5 is a diagrammatic representation in section of a second illustration of a new and improved form of a low friction duplex shear seal element which is particularly suited for employment in a sequence valve constructed as shown in FIGS. 3A and 3B.

Turning now to a consideration of FIGS. 4 and 5 of the drawing, there is illustrated therein versions of a low friction, noninterflow, duplex shear seal element of the type designed to be utilized in the mode valves 36, 38, 40, 42 and 44 of the sequence valving means 12 of FIG. 2. More specifically, the elements appearing in FIGS. 4 and 5 are of the type that is embodied in the mode valve 38, and which can be seen at 86 in FIGS. 3A, 3B and 6. Inasmuch as the duplex shear seal elements depicted in FIGS. 4 and 5 function in substantially the same manner and embody substantially the same form of construction, the description thereof which follows hereinafter will be limited to that element which is shown in FIG. 5.

Now, with reference to FIG. 5 of the drawing, the duplex shear seal element depicted therein, which for ease of identification has been denoted generally by the reference numeral 86, i.e., the same numeral which has been employed in FIGS. 3A and 6 to designate the shear seal element with which the sequence valve 38 shown therein is provided, is suitably retained in an appropriately configured bore that is provided for this purpose in a gate, e.g., the gate 84 of the sequence or mode valve 38. As depicted in FIG. 5, the duplex shear seal element 86 in accordance with the best mode embodiment thereof includes four leg-like seal members, i.e., the members 86*a*, 86*b*, 86*c* and 86*d*, respectively. The latter four members 86*a*, 86*b*, 86*c* and 86*d* may be viewed as functioning as two pairs, i.e., an inner pair thereof formed by the members 86*b* and 86*c*, and an outer pair thereof formed by the members 86*a* and 86*d*. More specifically, the duplex shear seal element 86 may be viewed as constituting a shear seal within a shear seal; namely, an inner shear seal 110 consisting of the piston area 112 and the leg-like members 86*b* and 86*c*, and an outer shear seal 114 consisting of the piston area 116 and the leg-like members 86*a* and 86*d*.

Continuing with a description of the nature of the construction and the method of operation of the duplex shear seal element 86 as illustrated in FIG. 5, it can be seen from the latter Figure that a first spring means 118 is provided for purposes of imparting a biasing force to the piston area 112 of the first shear seal 110, and a second spring means 120 is provided for purposes of imparting a biasing force to the piston area 116 of the second shear seal 114. In addition, a suitably located hole 122 is provided in the gate 84 which is operative as an inlet to the duplex shear seal element 86 for hydraulic fluid under pressure. Note is taken here of the following characteristics of the duplex shear seal element 86. First, the piston areas 112 and 116 of the shear seals 110 and 114, respectively, are equal in dimension. Secondly, the mode of operation of the duplex shear seal element 86 is such that only one of the shear seals 110 and 114 can seal at a time. Thirdly, each of the shear seals 110 and 114 is individually sealed against the portions of the gate 84 that are located in juxtaposed relation thereto. Fourthly, the fact sliding friction is low with the duplex shear seal element 86 is attributable to the smallness of the piston areas 112 and 116 of the shear seals 110 and 114, respectively. For purposes of describing the action of the duplex shear seal element 86, reference is had to FIG. 5 wherein certain relative positions which the element 86 may occupy are denoted in solid lines in the case of the position designated by the reference numeral 124 and in phantom lines in the case of the positions designated by the reference numerals 126, 128 and 130. To this end, when the duplex shear seal element 86 bears the relationship illustrated in FIG. 5 relative to the solid line position 124, sealing by the element 86 is effected by the inner shear seal 110. Then, when the duplex shear seal element 86 bears the relationship to the dotted line position 126 shown in FIG. 5, there is interflow around the leg-like members 86*b* and 86*c* of the inner shear seal 110, but this flow is then blocked by the outer shear seal 114. Next, when the duplex shear seal element 86 bears the relationship to the dotted line position 128 shown in FIG. 5, there is interflow around the leg-like members 86*a* and 86*d* of the outer shear seal 114, but the inner shear seal 110 is operative to block this flow. Lastly, when the duplex shear seal element 86 bears the relationship to the dotted line position 130 shown in FIG. 5, sealing is effected by the inner shear seal 110. As a final comment with regard to the showings of FIGS. 4 and 5, those portions of the duplex shear seal element that find correspondence in both of these Figures have been denoted in FIG. 4 by the addition of a prime to the numeral by which they are identified in FIG. 5.

Figure 7:
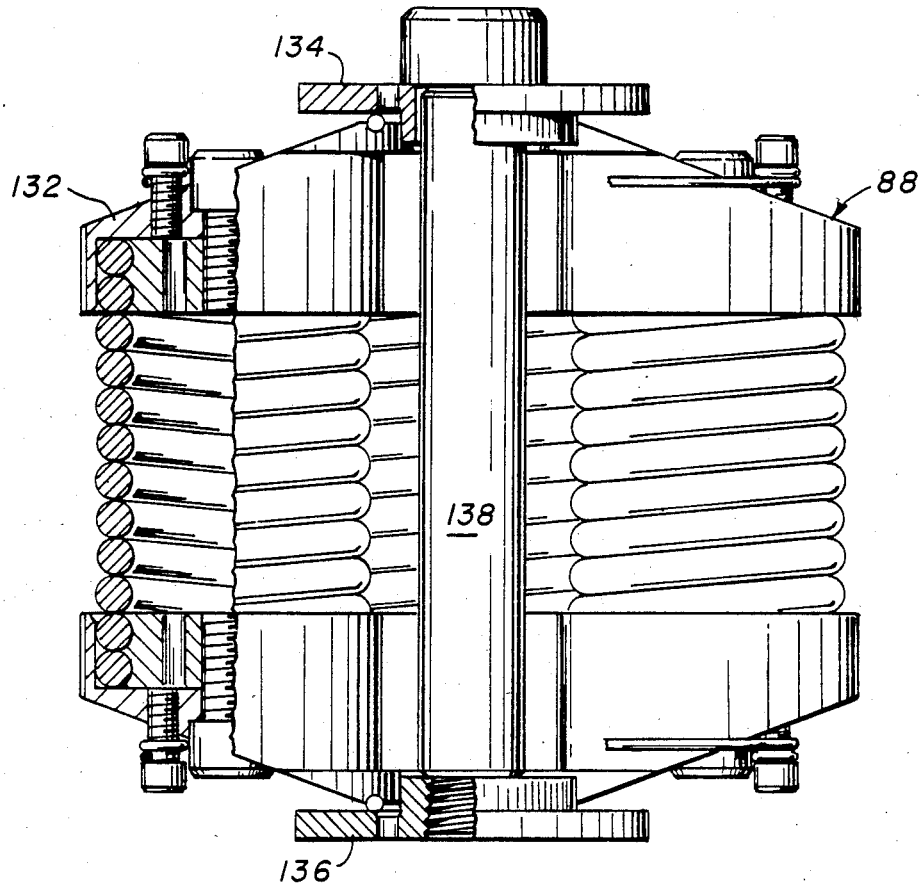
FIG. 7 is a side elevational view with some parts broken away of a new and improved form of a constant force spring which is particularly suited for employment in a sequence valve constructed as shown in FIGS. 3A and 3B.
Figure 8:
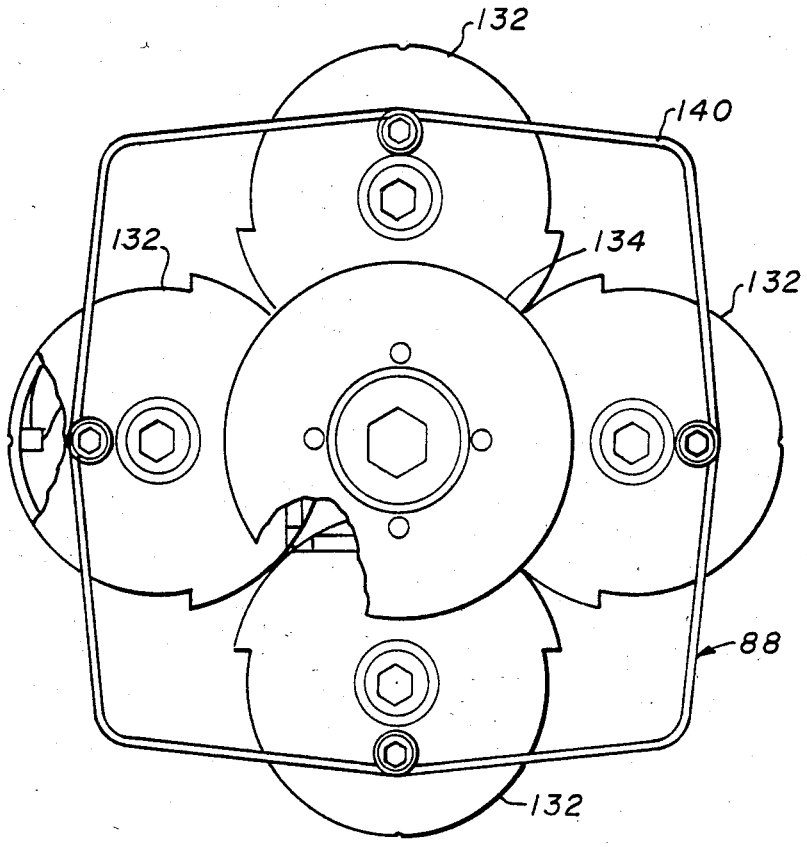
FIG. 8 is a plan view with some parts broken away of a new and improved form of a constant force spring which is particularly suited for employment in a sequence valve constructed as shown in FIGS. 3A and 3B.

Proceeding to a consideration of FIGS. 7 and 8 of the drawing, there is depicted therein a constant force spring which is particularly suited for employment in a sequence or mode valve, e.g., valves 36, 38, 40, 42 or 44, of the type that is designed for use in the sequence valving means 12 of FIG. 2. To this end, for ease of identification the constant force spring of FIGS. 7 and 8 is identified generally by the numeral 88, which is the same numeral that has been utilized to designate the constant force spring which the sequence or mode valve 38 of FIGS. 3A, 3B and 6 embodies. As has been mentioned previously herein, it has been found to be desirable to employ a constant force spring in subsea sequence valves, regulators and the like to effect the biasing action required thereby. A principal reason for this is that a constant force spring results in the existence of a lower dead band than that obtainable with a conventional spring. That is, a conventional spring has a spring rate, i.e., as the spring is compressed further, a higher force results. Thus, when a spring of non-constant force is used in a sequence valve, a higher pilot pressure is needed to complete the stroke than to begin the stroke, resulting in the creation of dead band. On the other hand, a constant force spring has a zero spring rate over a sufficiently large displacement range so that when it is used in a sequence valve, no dead band is produced as a consequence of spring action.

With further regard to the matter of the utilization of a constant force spring in a sequence valve, the spring bias force required in a sequence valve must be relatively high because of the fact that in order to maintain a small dead band the biasing force must be large as compared to the frictional forces that exist in the valve. For example, a sequence valve commonly requires a spring capable of providing a biasing force of approximately 1800 pounds over a deflection range of 0.3 inches. Constant force compression springs are not new in the prior art. However, commonly prior art forms of constant force springs have been utilized in applications requiring relatively small forces, and it is not known that any such prior art forms of constant force springs have been employed in applications requiring forces in the 2000 pound range. Moreover, prior art forms of constant force springs are known to be deficient in several respects. First, high force designs thereof result in the occurrence of stresses of too high magnitude in the arm of the spring. Secondly, they are undesirably characterized in that there is high sliding friction of the pin in the end. Such shortcomings, however, are obviated with constant force spring 88 constructed as illustrated in FIGS. 7 and 8.

As best understood with reference to FIGS. 7 and 8 of the drawing, in second with the best mode embodiment thereof, the constant force spring 88 includes four spring elements 132 arranged in equidistant relationship one to another around a common axis. Moreover the constant force spring 88 includes a pair of end caps 134 and 136, preferably at least one of which, i.e., the end cap 136 is threaded so as to be capable of being threadedly engaged to the member 138. Finally, a pair of spring retainers 140, only one of which is visible in FIG.

8, complete the construction, in terms of the major structural components thereof, of the constant force spring 88.

Figure 9:
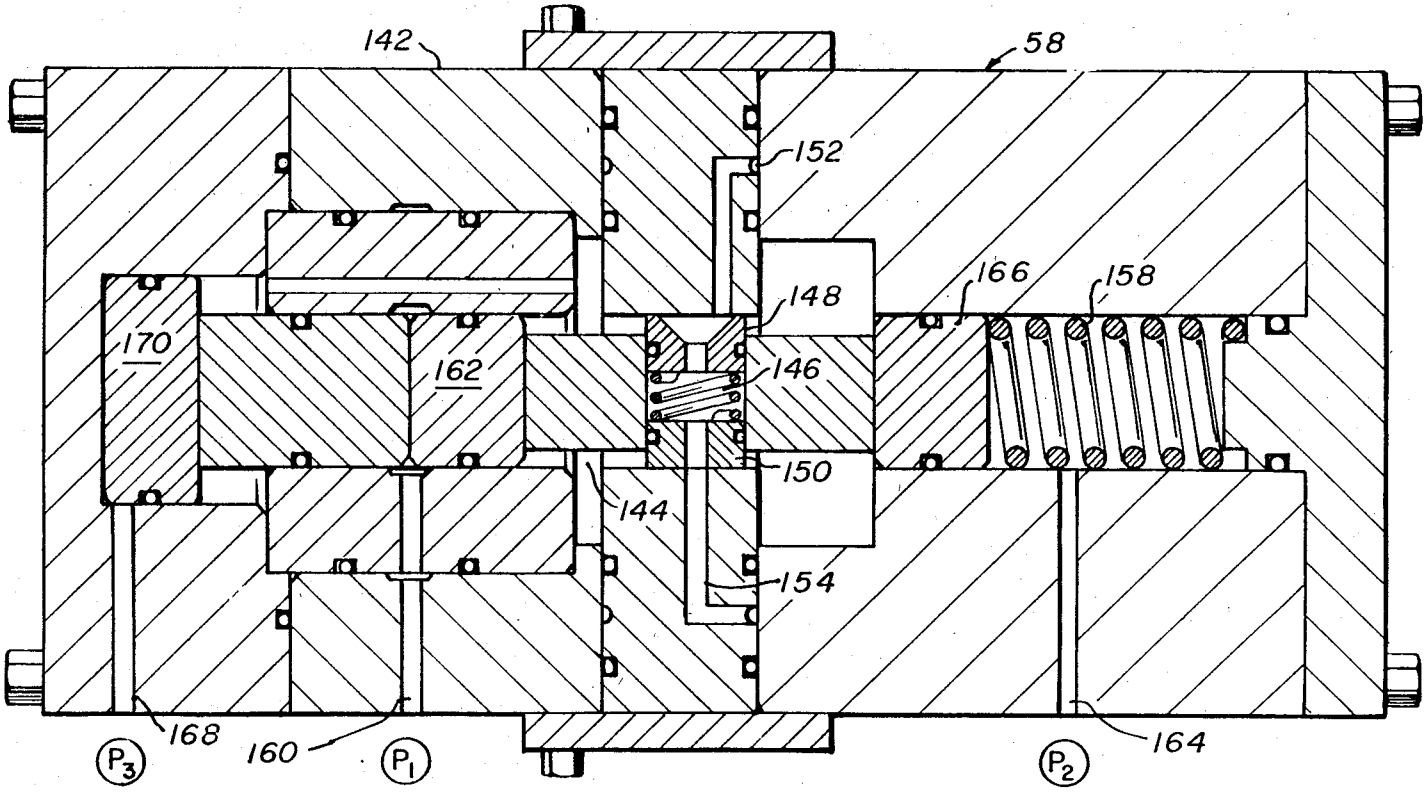
FIG. 9 is a diagrammatic representation in section of a new and improved intermediate valve which is particularly suited to be employed in cooperative association with the sequence valve shown in FIGS. 3A and 3B to form part of a subsea production control system constructed in accordance with the present invention.

Turning lastly to a consideration of FIG. 9 of the drawing, there is depicted therein an intermediate valve of the type that is designed to be cooperatively associated with sequence or mode valves, e.g., the valves 36, 38, 40, 42 and 44, in a sequence valving means 12 of the type found illustrated in FIG. 2. More specifically, the intermediate valve generally designated by reference numeral 58 in FIG. 9, for ease of understanding, bears the same reference numeral as the intermediate valve 58 that is shown in FIG. 2. Thus, as best understood with reference to FIG. 9, the intermediate valve 58 includes a body 142 having a generally cylindrical bore 144 suitably formed therewithin. A gate 146 is suitably mounted for movement within the bore 144. A pair of shear seals 148 and 150 are positioned in the gate 146, such that the axes of the shear seals 148 and 150 cooperate with a pair of generally circular holes 152 and 154 suitably formed in the sidewalls of the valve body 142 such as to provide an input thereto in the case of the hole or port 152 and an output therefrom in the case of the hole or port 154. With the components of the intermediate valve 58 positioned as shown in FIG. 9, input port 152 communicates, with output port 154 through the bores that are formed for this purpose in the shear seals 148 and 150. A seal is effected by the shear seals 148 and 150 as shown in FIG. 9 to prevent working fluid under pressure from entering the vent cavity which surrounds the gate 146. The latter gate 146 of the valve 58 is biased to the left as viewed with reference to FIG. 9 by the spring 158 such that the valve 58 occupies its normally open position. However, when the port 160 is pressurized, a force is developed across the piston 162 which is sufficient to overcome the force of the spring 158 and the friction of the shear seals 148 and 150 associated therewith, thereby causing the gate 146 to move to the right as viewed with reference to FIG. 9. This action causes the output port 154 to be blocked by the lower shear seal 150 and allows the input to flow into the valve 58 and into the vent cavity and subsequently to the system vent, from whence the fluid is ultimately vented to the sea. When piston port 164 is pressurized, the valve gate 146 shifts to the left as viewed with reference to FIG. 9 because the piston 162 has the same area as the piston 166. Consequently, since the pressure is the same at both pilot pistons 162 and 166, the forces generated across the pistons 162 and 166 are equal, thereby allowing the spring 158 to shift the gate 146 to the left as viewed with reference to FIG. 9. Now, when the piston port 168 is pressurized, the valve gate 146 shifts to the right as viewed with reference to FIG. 9 because the piston 170 has twice the area of pistons 162 and 166.

Thus, in accordance with the present invention there has been provided a new and improved form of a subsea production control system, which is operative for purposes of effecting control over the production of a subsea christmas tree from a surface location remote therefrom. Moreover, the subsea production control system of the present invention is operative in the manner of a sequenced hydraulic system; namely, the system includes valving means that is operative in a sequential fashion in response to the existence of certain predetermined pressure levels in a pilot line. Further, in accord with the present invention a subsea production control system is provided which is advantageously characterized in that it minimizes both the number of control lines that are required to be run between the subsea christmas tree and the surface control center from whence control over the subsea christmas tree is effected, i.e., eliminates the need for a line to be established for purposes of providing a reference pressure, and the number of subsea control valves required for operation of the system. In addition, the subsea production control system of the present invention possesses the flexibility of enabling a variety of different operating programs for subsea christmas trees to be executed therewith. Furthermore, in accord with the present invention a subsea production control system is provided that utilizes a new and improved form of sequence valving means, the latter being characterized both in that it has a small dead band and in that it permits the elimination of the use of shuttle valves interposed between the sequence valving means and the valve means of the subsea christmas tree. Also, the subsea production control system of the present invention embodies such a new and improved constant force spring means which is operative for purposes of effecting a biasing of the gate means of the sequence valving means such that the latter possesses a mode of operation wherein the biasing thereof is accomplished by both constant force mechanical spring means and hydraulic pressure, and wherein assistance is provided in the form of hydraulic pressure in the shifting of the internal components of the sequence valving means to cause the latter to occupy either an open or a closed operating position. Penultimately, in accord with the present invention a subsea production control system is provided which embodies such a new and improved sequence valving means wherein the latter in turn embodies a new and improved low friction duplex shear seal means that is operative to prevent interflow within the sequence valving means. Lastly, the subsea production control system of the present invention allows for the use of a multi-piston control valve means located in the flow lines that functions to fluidically interconnect the sequence valving means with the valve means of the christmas tree.

While only one embodiment of the subsea production control system of our invention has been depicted in the drawing and has been described herein, it will be appreciated that modifications can be made thereto by those skilled in the art without departing from the essence of the invention. We, therefore, intend by the appended claims to cover such other modifications, which fall within the true spirit and scope of our invention.

We claim:

1. A sequence valve employable in a subsea production control system comprising:

a. a housing having a bore formed therein;

b. input means formed in said housing, said input means being connectible to a supply of fluid for supplying fluid to said housing;

c. output means formed in said housing, said output means being operative to provide an output from the sequence valve;

d. gate means mounted in said bore for movement in a first direction and in a second direction so as to be selectively positionable in a plurality of positions, said plurality of positions defining different operating modes of the sequence valve;

e. constant force biasing means retained in said housing in such a manner as to provide the sequence valve with a small dead band, said constant force biasing means being operative to bias said gate means to one of said plurality of positions;

f. pilot pressure input means formed in said housing, said pilot pressure input means being connected to a source of pilot pressure so as to be capable of receiving a plurality of commands therefrom, said plurality of commands being of unique character such that said gate means when occupying said one of said plurality of positions is caused to move to another of said plurality of positions when a particular one of said plurality of commands is transmitted to said pilot pressure input means; and g. quick shift means provided in said housing, said quick shift means including first means operative when said gate means is moving in said first direction to assist said gate means in moving in said first direction thereby causing said gate means to move more quickly in said first direction than said gate means would otherwise move, said quick shift means further including second means operative when said gate means is moving in said second direction to assist said gate means in moving in said second direction thereby causing said gate means to move more quickly in said second direction than said gate means would otherwise move.

2. The sequence valve as set forth in claim 1 wherein said constant force biasing means comprises a constant force spring.

3. The sequence valve as set forth in claim 2 further including duplex shear seal means supported in said housing in cooperative association with said gate means, said duplex shear seal means being operative to prevent interflow within the sequence valve as said gate means moves between said one of said plurality of positions and said another of said plurality of positions.

4. The sequence valve as set forth in claim 3 wherein said duplex shear seal means includes an inner seal means having a first seal member extending substantially symmetrically in a first direction about a first axis, said first seal member including a substantially closed end and a free end, and first spring means engaging said substantially closed end of said first seal member, said first spring means being operative for biasing said free end of said first seal member into sealing relation with a surface located in juxtaposed relation thereto.

5. The sequence valve as set forth in claim 4 wherein said duplex shear seal means further includes an outer seal means, said outer seal means forming an integral unit with said inner seal means so as to provide a seal within a seal, said outer seal means including a second seal member extending substantially symmetrically in the same direction and about the same axis as said first seal member so as to be concentric with said first seal member, said second seal member including a substantially closed end and a free end, and second spring means engaging said substantially closed end of said second seal member, said second spring means being operative for biasing said free end of said second seal member into sealing relation with a surface located in juxtaposed relation thereto.

* * * * *